US009181055B2

(12) United States Patent
Kosaka

(10) Patent No.: US 9,181,055 B2
(45) Date of Patent: Nov. 10, 2015

(54) IMAGE FORMING APPARATUS

(71) Applicant: KYOCERA Document Solutions Inc., Osaka (JP)

(72) Inventor: Mariko Kosaka, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/525,994

(22) Filed: Oct. 28, 2014

(65) Prior Publication Data

US 2015/0115522 A1 Apr. 30, 2015

(30) Foreign Application Priority Data

Oct. 31, 2013 (JP) ..... 2013-226723

(51) Int. Cl.
*B65H 7/04* (2006.01)
*B65H 7/20* (2006.01)

(52) U.S. Cl.
CPC .. *B65H 7/04* (2013.01); *B65H 7/20* (2013.01); *B65H 2407/50* (2013.01); *B65H 2513/511* (2013.01); *B65H 2557/652* (2013.01); *B65H 2601/10* (2013.01)

(58) Field of Classification Search
CPC ..... B65H 7/02; B65H 7/04; B65H 7/06; B65H 7/14; B65H 7/20; B65H 2407/50; B65H 2513/511; B65H 2557/652; B65H 2601/10
See application file for complete search history.

(56) References Cited

U.S. PATENT DOCUMENTS

| | | | | |
|---|---|---|---|---|
| 6,015,147 | A * | 1/2000 | Kimura et al. | 271/163 |
| 7,796,909 | B2 * | 9/2010 | Nishimura | 399/75 |
| 8,626,050 | B2 * | 1/2014 | Takahashi | 399/388 |
| 2006/0255531 | A1 * | 11/2006 | Azzopardi et al. | 271/171 |
| 2015/0102085 | A1 * | 4/2015 | Balili et al. | 227/39 |
| 2015/0102548 | A1 * | 4/2015 | Balili et al. | 270/58.09 |
| 2015/0104202 | A1 * | 4/2015 | Caneza et al. | 399/16 |

FOREIGN PATENT DOCUMENTS

| | | | |
|---|---|---|---|
| JP | 2007-168102 | A | 7/2007 |
| JP | 2007168102 | A * | 7/2007 |

* cited by examiner

*Primary Examiner* — Patrick Cicchino

(57) ABSTRACT

An image forming apparatus includes: an apparatus body, a paper feed cassette, a feed section, an operation control section, a paper passage detection sensor, a cassette attachment-detachment detection sensor, a paper presence-absence detection sensor, a sensor failure determination section, and an alarm control section. The paper passage detection sensor detects whether or not paper has passed through a position. The cassette attachment-detachment detection sensor detects attachment or detachment of the paper feed cassette. The paper presence-absence detection sensor detects paper absence when the paper feed cassette is withdrawn from the apparatus body. The sensor failure determination section determines that the paper presence-absence detection sensor is in failure. The alarm control section, when passage of the paper is not detected before passage of a predefined time period, alarms that the feeding of the paper has failed.

5 Claims, 7 Drawing Sheets

IMAGE FORMING APPARATUS

INCORPORATION BY REFERENCE

This application claims priority to Japanese Patent Application No. 2013-226723 filed on 31 Oct. 2013, the entire contents of which are incorporated by reference herein.

BACKGROUND

This disclosure relates to an image forming apparatus, and more specifically to a technology of detecting failure of a sensor detecting paper presence or absence in a paper feed cassette.

Typically, an image forming apparatus of an electrophotographic type such as a copier, a printer, a facsimile device, or a multifunction peripheral includes a paper feed cassette which is attachable to and detachable from an apparatus body and which is capable of storing a large volume of paper. At time of printing execution, the image forming apparatus feeds, individually page by page, the paper from the paper feed cassette fitted to the apparatus body to an image formation section in the apparatus body.

Without any paper in the paper feed cassette, the image forming apparatus cannot feed paper to the image formation section, and thus cannot execute print processing. Thus, known as the image forming apparatus is the one which includes a paper presence-absence detection sensor for detecting paper presence or absence in the paper feed cassette, and which stops an operation of paper feed from the paper feed cassette in a case where the paper presence-absence detection sensor detects that paper is absent in the paper feed cassette.

SUMMARY

Suggested as one aspect of this disclosure is a technology obtained by further improving the aforementioned technology.

An image forming apparatus according to one aspect of this disclosure includes: an apparatus body, a paper feed cassette, a feed section, an operation control section, a paper passage detection sensor, a cassette attachment-detachment detection sensor, a paper presence-absence detection sensor, a sensor failure determination section, and an alarm control section.

The paper feed cassette is attachable to and detachable from the apparatus body.

The feed section feeds, into the apparatus body, paper stored in the paper feed cassette.

The operation control section controls an operation of feeding the paper by the feed section.

The paper passage detection sensor is installed along a conveyance path in the apparatus body, and detects whether or not the paper has passed through a position corresponding to a position at which the installation is achieved.

The cassette attachment-detachment detection sensor detects attachment or detachment of the paper feed cassette to or from the apparatus body.

The paper presence-absence detection sensor detects presence or absence of the paper in the paper feed cassette, and detects the paper absence regardless of whether the paper is present or absent when the paper feed cassette is withdrawn from the apparatus body.

The sensor failure determination section, when the paper presence-absence detection sensor detects the paper presence in a case where the cassette attachment-detachment detection sensor detects that the paper feed cassette is withdrawn from the apparatus body, determining that the paper presence-absence detection sensor is in failure and set a failure detection flag.

The alarm control section, in a case where the operation control section has made the feed section execute the feed operation in a state in which the failure detection flag is set, when the paper passage detection sensor does not detect passage of the paper before passage of a predefined time period from a time point at which the execution of the feed operation was started, alarms a user that the feeding of the paper has failed.

DETAILED DESCRIPTION

Figure 1:
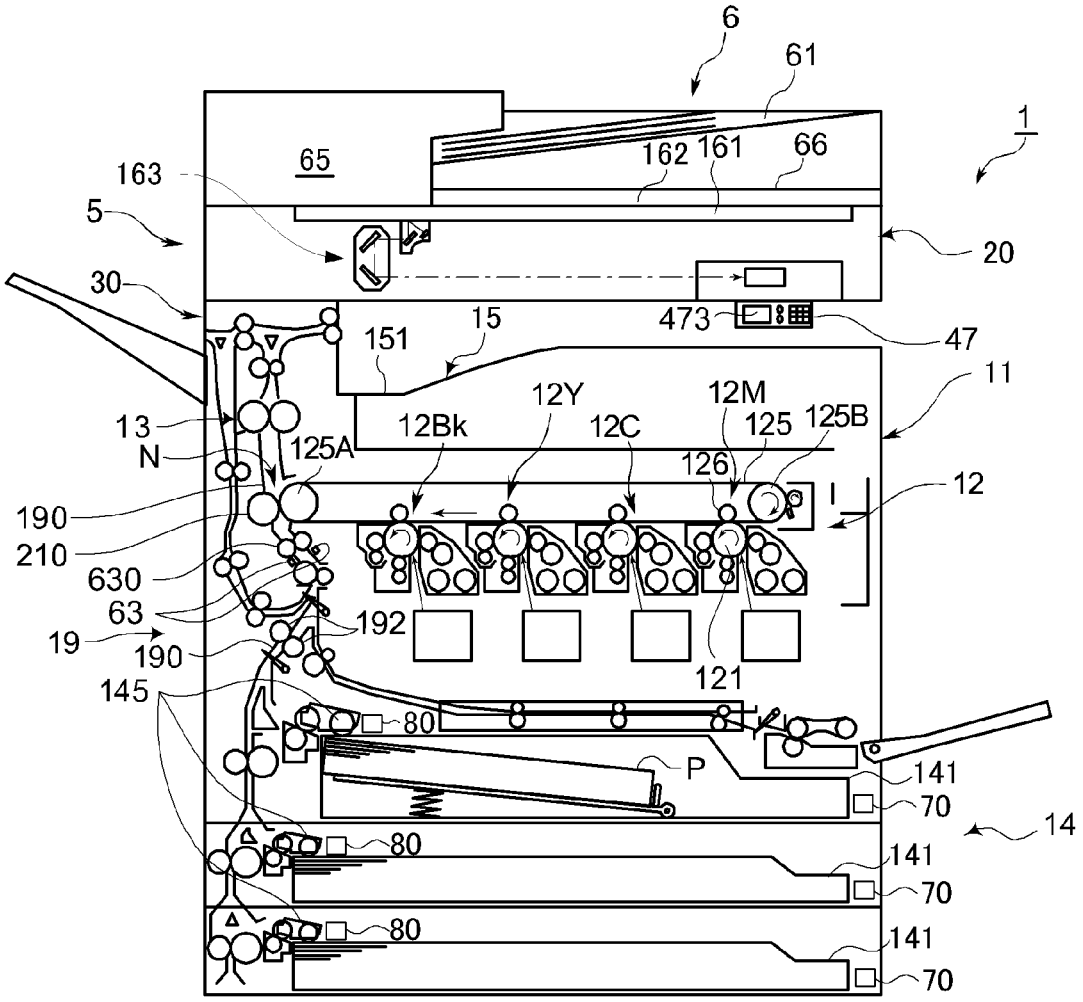
FIG. 1 is an elevation sectional view showing a structure of an image forming apparatus according to one embodiment of this disclosure.

Hereinafter, an image forming apparatus according to one embodiment of this disclosure will be described with reference to the drawings. FIG. 1 is an elevation sectional view showing a structure of the image forming apparatus according to one embodiment of this disclosure. The image forming apparatus 1 is a multifunction peripheral combining a plurality of functions, for example, a copy function, a printer function, a scanner function, and a facsimile function, etc.

The image forming apparatus 1 is roughly composed of an apparatus body 11; a document reader 20 oppositely arranged above the apparatus body 11; and a joining part 30 provided between the document reader 20 and the apparatus body 11.

The document reader 20 is supported at a top end part of the joining part 30. The document reader 20 includes: a document reading section 5 and a document conveyance section 6.

The document reading section 5 includes contact glass 161 which is fitted at a top opening of the document reading section 5 housing and which is provided for loading a document. The contact glass 161 includes: a document fixation reading section (not shown) that reads a loaded document; and a document conveyance reading section (not shown) that reads a document conveyed by the document conveyance section 6. The document reading section 5 further includes: a document pressing cover 162 of an openable and closable type that presses the document loaded on the contact glass 161; and a reading unit 163 that reads each image of the document loaded at the document fixation reading section of the contact glass 161 and the document conveyed to the document conveyance reading section of the contact glass 161. The reading unit 163 optically reads the image of the document by using an image sensor such as a CCD (Charge Coupled Device) or a CMOS (Complementary Metal Oxide Semiconductor), and generates image data.

The document conveyance section 6 includes: a document loading base 61 loading a document; a document discharge section from which an image-read document is discharged; and a document conveyance mechanism 65. The document conveyance mechanism 65 includes: a paper feed roller, a conveyance roller, and a paper inversion mechanism (not shown). The document conveyance mechanism 65, as a result of driving of the paper feed roller and the conveyance roller, draws out documents loaded on the document loading base 61 page by page and conveys them to the document conveyance reading section of the contact glass 161 to thereby permit reading by the reading unit 163, and then discharges them to the document discharge section 66. Moreover, by inverting the document by the paper inversion mechanism and conveying it again to the document conveyance reading section of the contact glass 161, the document conveyance mechanism 65 permits images of both sides of this document to be read by the reading unit 163.

Furthermore, the document conveyance section 6 is provided in a manner such as to be turnable with respect to the document reading section 5 so that its front side becomes upwardly movable. As a result of upwardly moving the front side of the document conveyance section 6 to open a top surface of the contact glass 161 as a document base, a user can load a document to be read, for example, a double-paged book on the top surface of the contact glass 161.

Arranged on a front surface of the document reader 20 is an operation section 47. The operation section 47, for various operations and processing executable by the image forming apparatus 1, receives, from the user, instructions such as an image formation operation execution instruction and a document reading operation execution instruction. The operation section 47 includes a display section 473 that displays an operation guide to the user, etc.

The apparatus body 11 includes: an image formation section 12, a fixing section 13, a paper feed section 14, a paper discharge section 15, a conveyance section 19, etc.

In a case where the image forming apparatus 1 performs a document reading operation, the document reading section 5 optically reads an image of the document conveyed by the document conveyance section 6 or the document loaded on the contact glass 161, and generates image data. The image data generated by the document reading section 5 is saved into, for example, a built-in HDD 92 or a network-connected computer, etc.

In a case where the image forming apparatus 1 performs an image formation operation, based on the image data generated by the aforementioned document reading operation, or image data received from a user terminal device such as the network-connected computer or a smart phone, or image data stored in the built-in HDD 92, the image formation section 12 forms a toner image on paper P fed by the paper feed section 14 and the conveyance section 19. Image formation units 12M, 12C, 12Y, and 12Bk of the image formation section 12 each include: a photoconductive drum 121; a developing device that supplies a toner to the photoconductive drum 121; a toner cartridge that stores a toner; a charging device, an exposing device; and a primary transfer roller 126.

To perform color printing, each of the magenta image formation unit 12M, the cyan image formation unit 12C, the yellow image formation unit 12Y, and the black image formation unit 12Bk of the image formation section 12, based on images of respective color components forming the image data, forms a toner image on the photoconductive drum 121 through charge, exposure, and development processes, and transfers the toner image onto an intermediate transfer belt 125 stretched around a driving roller 125A and a driven roller 125B by the primary transfer roller 126.

The intermediate transfer belt 125 has an image-carrying surface, onto which the toner images are transferred, set on its outer circumferential surface, and is driven by the driving roller 125A while abutting a circumferential surface of the photoconductive drums 121. The intermediate transfer belt 125 endlessly runs between the driving roller 125A and the driven roller 125B simultaneously with each photoconductive drum 121. The toner images of the respective colors transferred onto the intermediate transfer belt 125 are superposed on one another on the intermediate transfer belt 125 after transfer timing adjustment, turning into a color toner image.

A feed section 18 (see FIG. 3) to be described later includes the paper feed section 14 and the conveyance section 19, and feeds, into the apparatus body 11, the paper P stored in each paper feed cassette 141.

The conveyance section 19 includes a plurality of conveyance roller pairs 192 provided at appropriate places of the conveyance path 190. An operation control section 100 (see FIG. 3) to be described later drives the conveyance roller pairs 192 into rotation, and conveys, towards a nip part N and the fixing section 13, the paper P fed from each paper feed cassette 141 onto the conveyance path 190 by the paper feed section 14.

A secondary transfer roller 210 transfers the color toner image formed on a surface of the intermediate transfer belt 125 to the paper P fed by the feed section 18 at the nip part N sandwiched by the driving roller 125A with the intermediate transfer belt 125 in-between. Then the fixing section 13 fixes the toner image on the paper P to the paper P through thermal compression. The paper P on which the color image has been formed and already subjected to fixing processing is discharged to a discharge tray 151.

Disposed upstream of the nip part N in a direction in which the paper P is conveyed by the feed section 18 is a registration roller 630. The registration roller 630, for example, makes conveyance of the paper P on standby for the purpose of synchronizing timing of the toner image transfer from the intermediate transfer belt 125 by the secondary transfer roller 210 at the nip part N described above with timing of conveying the paper P to the nip part N by the feed section 18.

Disposed upstream of this registration roller 630 in the direction in which the paper P is conveyed by the feed section 18 is a paper passage detection sensor 63. The paper passage detection sensor 63 has: a light emission section disposed on one side wall side of the conveyance path 190; and a light reception section which is disposed at an other side wall section at a position opposing the light emission section and which receives light from the light emission section, and detects whether or not the paper P has passed through a position on the conveyance path 190 corresponding to a position at which the paper passage detection sensor 63 is installed.

The paper feed section 14 includes: a plurality of paper feed cassettes 141 including a manual feed tray; and pickup rollers 145. The operation control section 100 drives the pickup roller 145 of the paper feed cassette 141 storing paper P of a size specified by user's instructions into rotation, and feeds the paper P stored in each paper feed cassette 141 towards the conveyance path 190.

The paper feed cassette 141 of the paper feed section 14 can be attached to and detached from the apparatus body 11. In an example of FIG. 1, the paper P feed cassette 141 can be withdrawn to the left in the figure.

Provided at an appropriate place of the apparatus body 11 are cassette attachment-detachment detection sensors 70. In the example of FIG. 1, the cassette attachment-detachment detection sensor 70 is arranged at right front of each of the paper feed cassettes 141 when viewed from the apparatus front.

The cassette attachment-detachment detection sensor 70 detects that the paper feed cassette 141 has been fitted to the apparatus body 11 and that it has been withdrawn from the apparatus body 11. The cassette attachment-detachment detection sensor 70 is formed of, for example, a mechanical switch or an optical sensor, detects presence or absence of the paper feed cassette 141 at a sensor disposition position, and detects that the paper feed cassette 141 is fitted to the apparatus body 11 if the cassette is present, and detects that the paper feed cassette 141 is detached from the apparatus body 11 (withdrawn from the apparatus body 11) if the cassette is absent.

Also provided in the apparatus body 11 are paper presence-absence detection sensors 80. The paper presence-absence detection sensor 80 is arranged near the pickup roller 145 of each paper feed cassette 141, and detects presence or absence of the paper P in each paper feed cassette 141.

Figure 2A:
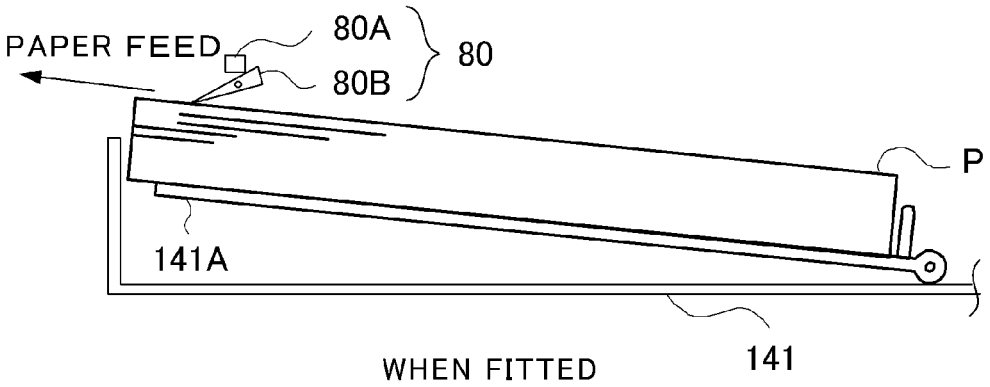
FIGS. 2A and 2B are partial sectional views of a paper feed cassette and a paper presence-absence detection sensor according to one embodiment of this disclosure.
Figure 2B:
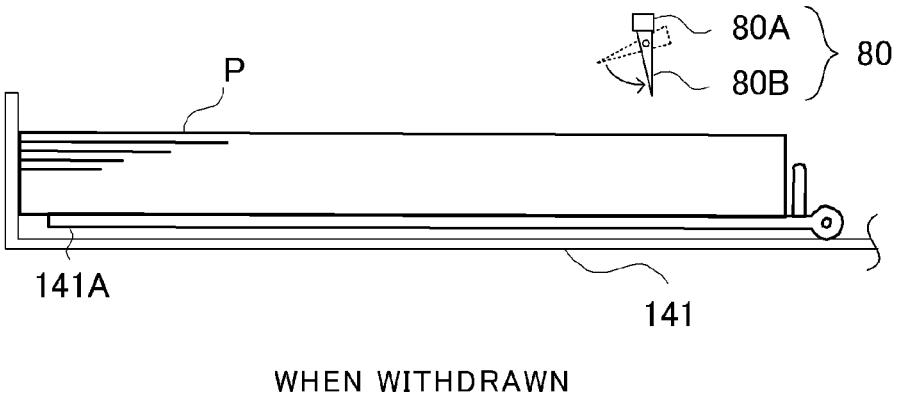

Referring to FIGS. 2A and 2B, a configuration example of the paper presence-absence detection sensor 80 will be described. FIG. 2A is a partial sectional view of the paper feed cassette 141 and the paper presence-absence detection sensor 80 when fitted to the apparatus body 11. FIG. 2B is a partial sectional view of the paper feed cassette 141 and the paper presence-absence detection sensor 80 when withdrawn from the apparatus body 11.

In the paper feed cassette 141, the paper P is loaded on a paper loading plate 141A of metal. When the paper feed cassette 141 is fitted to the apparatus body 11, the paper loading plate 141A is biased upward by a bias mechanism (not shown), and turns with one end opposing a paper feed end as an axis. As a result, regardless of a volume of the loaded paper P, the topmost paper P is brought into pressure contact with the pickup roller 145 (not shown in FIGS. 2A and 2B), and is fed into the apparatus body 11 page by page.

The paper presence-absence detection sensor 80 is composed of a sensor section 80A and a detection lever 80B. The sensor section 80A is an optical sensor composed of a light emission section and a light reception section (not shown). The detection lever 80B is a member capable of turning around the axis, and has its tip protruding with respect to the paper P above the paper P.

A portion of the detection lever 80B higher than the axis overlaps with the sensor section 80A and functions as a light blocking plate that blocks light from the light emission section. As shown in FIG. 2A, in a case where the paper feed cassette 141 is fitted to the apparatus body 11, a tip of the detection lever 80B is pressed by the paper P loaded on the paper loading plate 141A and biased upward, and the detection lever 80B turns at an angle in accordance with the volume of the loaded paper P, that is, thickness of the loaded paper P. When at least one piece of paper P is loaded on the paper loading plate 141A, the detection lever 80B turns and the sensor section 80A and the detection lever 80B do not overlap with each other, and thus the light reception section in the sensor section 80A can receive light from the light emission section. In this case, the sensor section 80A detects paper P presence.

On the other hand, as shown in FIG. 2B, when the paper feed cassette 141 is withdrawn from the apparatus body 11, the paper loading plate 141A is returned to a position of a bottom surface of the paper feed cassette 141 together with the loaded paper P. At this point, as a result of separation of the topmost paper P from the tip of the detection lever 80B, the detection lever 80B turns in a direction opposite to a direction when the paper feed cassette 141 is fitted to the apparatus body 11, thereby turning into a vertical posture, and the portion of the detection lever 80B higher than the axis overlaps with the sensor section 80A to block the light from the light emission section. As a result, the light reception section in the sensor section 80A can no longer receive the light from the light emission section, and the sensor section 80A detects paper P absence.

Also when the paper P is absent in a case where the paper feed cassette 141 is fitted to the apparatus body 11, the tip of the detection lever 80B fits into a notch part of the paper loading plate 141A, and the detection lever 80B turns into a vertical posture. As a result, the sensor section 80A detects paper P absence.

As described above, the paper presence-absence detection sensor 80 is configured in a manner such as to detect paper P presence or absence in the paper feed cassette 141, and also detects paper P absence regardless of whether paper P is present or absent when the paper feed cassette 141 is withdrawn from the apparatus body 11.

Figure 3:
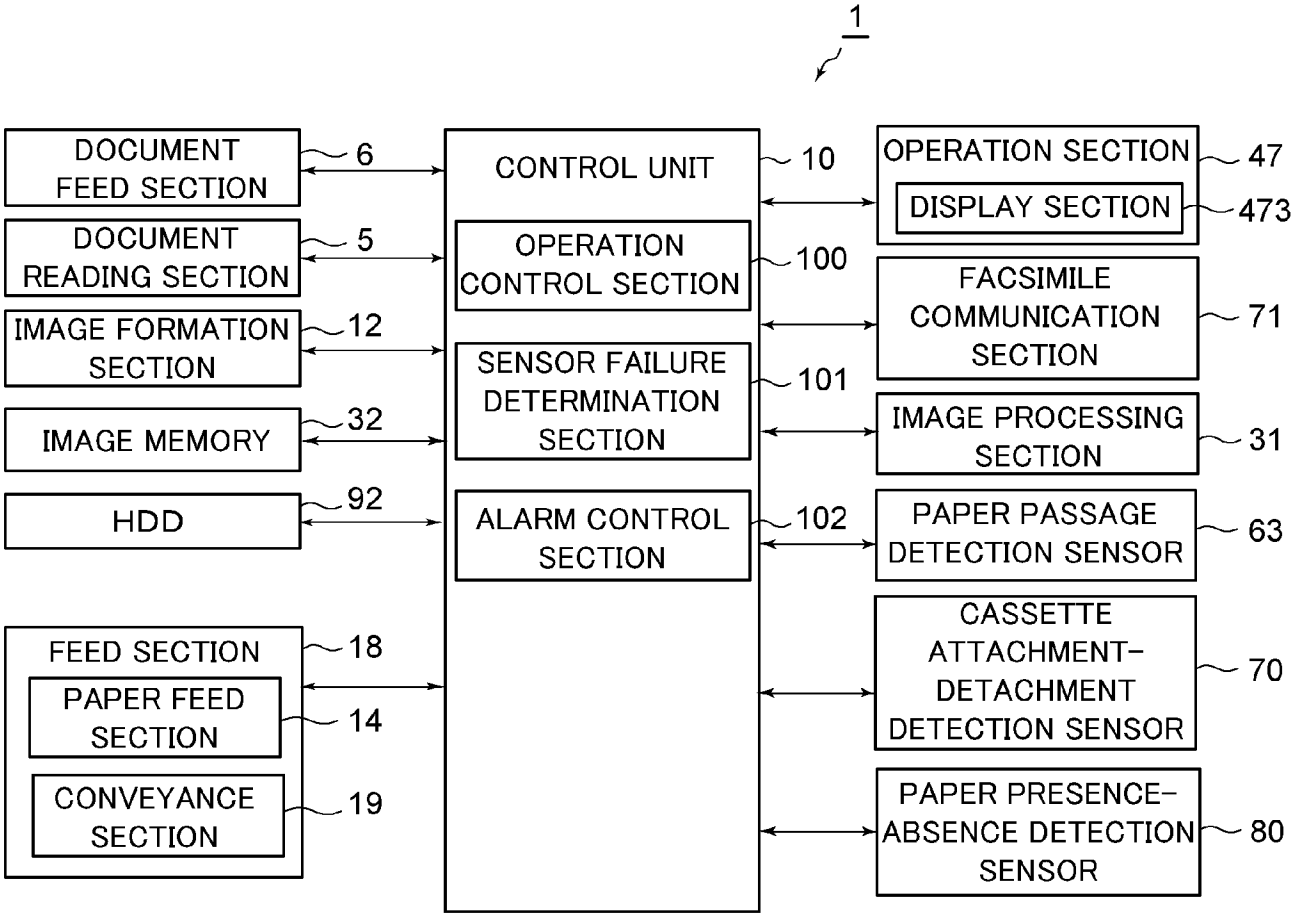
FIG. 3 is a functional block diagram showing main inner configuration of the image forming apparatus according to one embodiment of this disclosure.

Next, configuration of the image forming apparatus 1 will be described. FIG. 3 is a functional block diagram showing main inner configuration of the image forming apparatus 1.

The image forming apparatus 1 includes a control unit 10. The control unit 10 is composed of a CPU (Central Processing Unit), a RAM, a ROM, a dedicated hardware circuit, etc., and is responsible for overall operation control of the image forming apparatus 1.

The document reading section 5, under control by the control unit 10, includes the aforementioned reading mechanism 163 having a light irradiation section, a CCD sensor, etc. The document reading section 5 irradiates a document with light by the light irradiation section, and receives reflection light of the aforementioned light with the CCD sensor, thereby reading an image from the document.

The image processing section 31 performs image processing on image data of an image read at the document reading section 5 when necessary. For example, the image processing section 31 performs predefined image processing such as shading correction for the purpose of improving quality after the image read by the document reading section 5 is subjected to image formation by the image formation section 12.

An image memory 32 is a region which temporarily stores data of the document image obtained through reading by the document reading section 5 and which temporarily saves data of the image formation section 12 targeted for printing.

The image formation section 12 performs image formation on print data read at the document reading section 5, print data received from the network-connected computer, etc.

The operation section 47 receives instructions from the user for the various operations and processing executable by the image forming apparatus 1. The operation section 47 includes the display section 473 of a touch-panel type formed of a liquid crystal displayer.

The display section 473 displays various screens, such as an operation screen, a preview screen, and a print job status check screen when the image forming apparatus 1 is in a normal operation mode. On the other hand, the display section 473 lights off when the image forming apparatus 1 in a sleep mode.

A facsimile communication section 71 includes an encoding-decoding section, a modulation and demodulation section, and an NCU (Network Control Unit), not shown, and performs facsimile transmission by use of a public phone line network.

An HDD 92 is a large-capacity storage device that stores, for example, a document image read by the document reading section 5.

The feed section 18, as described above, includes the paper feed section 14 and the conveyance section 19, and executes feed operations including a paper P feed operation of feeding the paper P onto the conveyance path 190 from each paper feed cassette 141 and a conveyance operation of conveying the paper P on the conveyance path 190.

The paper passage detection sensor 63, as described above, is installed along the conveyance path 190 in the apparatus body 11, and detects whether or not the paper P has passed through a position corresponding to a position at which this installation is achieved.

The cassette attachment-detachment detection sensor 70, as described above, detects attachment and detachment of the paper feed cassette 141.

The paper presence-absence detection sensor 80, as described above, detects presence or absence of the paper P in the paper feed cassette 141. Moreover, the paper presence-absence detection sensor 80 detect paper P absence regardless of whether the paper P is present or absent when the paper feed cassette 141 is withdrawn from the apparatus body 11.

The control unit 10 includes: the operation control section 100, a sensor failure determination section 101, and an alarm control section 102. As a result of CPU operation in accordance with a touch panel control program stored in the memory, the ROM, or the HDD 92, etc., in the control unit 10, these various sections function. Alternatively, the control unit 10 may include, for example, a dedicated hardware circuit, etc., corresponding to the aforementioned various sections, thereby functioning as these various sections.

The operation control section 100 is connected to the document reading section 5, the document feed section 6, an image processing section 31, the image memory 32, the image formation section 12, the operation section 47, the facsimile communication section 71, the HDD (hard disc drive) 92, the feed section 18, the paper passage detection sensor 63, the cassette attachment-detachment detection sensor 70, the paper presence-absence detection sensor 80, etc., and performs driving control of these various sections. In particular, the operation control section 100 makes the feed section 18 perform the feed operations including the paper feed operation of feeding the paper P onto the conveyance path 190 from each paper feed cassette 141 and the conveyance operation of conveying the paper P on the conveyance path 190.

The sensor failure determination section 101, based on each detection result of the cassette attachment-detachment detection sensor 70 and the paper presence-absence detection sensor 80, determines whether or not the paper presence-absence detection sensor 80 is in failure. Then the sensor failure determination section 101 sets a failure detection flag in a case where it is determined that the paper presence-absence detection sensor 80 is in failure.

More specifically, the sensor failure determination section 101, upon detection of paper P presence when the paper feed cassette 141 is withdrawn from the apparatus body 11, determines that the paper presence-absence detection sensor 80 is in failure. This is because the detection of the paper P presence regardless of the configuration such that the paper presence-absence detection sensor 80 detects paper P absence regardless of whether paper P is present or absent when the paper feed cassette 141 is withdrawn from the apparatus body 11 leads to assumption that the paper presence-absence detection sensor 80 is physically in failure or that erroneous detection is occurring due to electrical noise of the sensor with high probability.

Moreover, the sensor failure determination section 101 resets the failure detection flag when the paper presence-absence detection sensor 80 detects paper P absence when the failure detection flag is set and the paper feed cassette 141 is withdrawn from the apparatus body 11. This is because the paper presence-absence detection sensor 80 is assumed to be restored from a failure state to a normal state.

The operation control section 100 makes the feed section 18 execute the feed operations regardless of whether or not the aforementioned failure detection flag is set.

The alarm control section 102 makes the display section 473 display an alarm screen showing an operation state of the image forming apparatus 1 to thereby alarm the user of the operation state of the image forming apparatus 1.

In a case where the failure detection flag is set, that is, in a case where the paper presence-absence detection sensor 80 is in failure, when the paper passage detection sensor 63 does not detect passage of the paper P before passage of a predetermined time period from a time point at which the execution of the feed operations was started, assumed is (1) a state in which the paper P is not stored in each paper feed cassette 141 or (2) a state in which a paper P jam is occurring on the pickup roller 145 of the paper feed section 14 or the conveyance path 190 of the conveyance section 19. Thus, in a case where the operation control section 100 has made the feed section 18 execute the feed operations in a state in which the failure detection flag is set, when the paper passage detection sensor 63 does not detect the passage of the paper P before the passage of the predefined time period from the time point at which the execution of the feed operations was started, the alarm control section 102 makes the display section 473 display, for example, an alarm screen D1 shown in FIG. 4A, and alarms the user that the feeding of the paper P has failed.

In a case where the failure detection flag is not set, that is, in a case where the paper presence-absence detection sensor 80 is not in failure, when the paper passage detection sensor 63 does not detect the passage of the paper P before the passage of the predefined time period from the time point at which the execution of the feed operations was started, the operation control section 100 performs retry control of making the feed section 18 execute the feed operations again.

When the paper passage detection sensor 63 does not detect the passage of the paper P even in a case where the aforementioned retry control has been performed a predetermined number of times, assumed is a state in which a paper P jam is occurring on the pickup roller 145 of the paper feed section 14 or the conveyance path 190 of the conveyance section 19. Thus, in a case where the operation control section 100 has made the feed section 18 execute the feed operations in a state in which the failure detection flag is not set, when the paper passage detection sensor 63 does not detect the passage of the paper P before the passage of the predefined time period from the time point at which the execution of the feed operations was started, the alarm control section 102 makes the display section 473 display, for example, an alarm screen D2 shown in FIG. 4B, and alarms the user that an unachieved jam has occurred.

Figure 5:
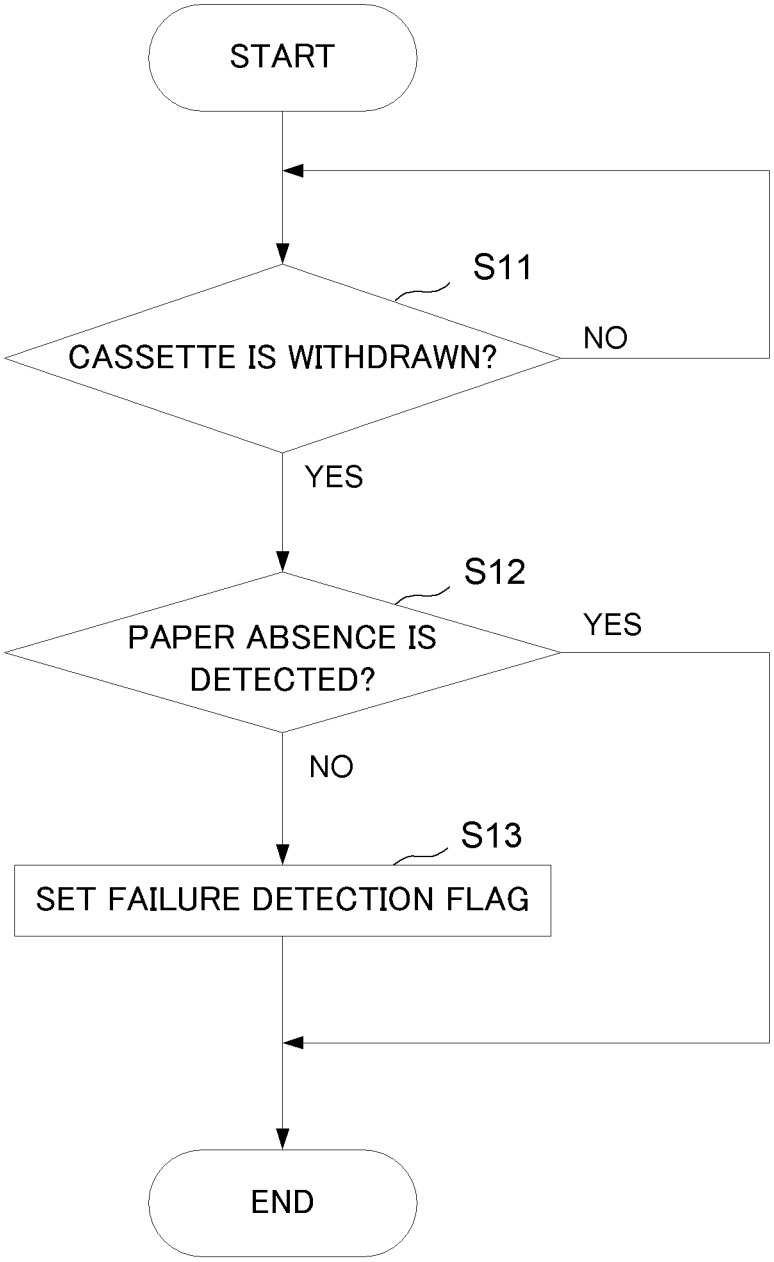
FIG. 5 is a flowchart showing a flow of failure detection processing of the paper presence-absence detection sensor of the image forming apparatus according to one embodiment of this disclosure.

Next, operations of the image forming apparatus 1 with the aforementioned configuration will be described. FIG. 5 is a flowchart showing a flow of failure detection processing of the paper presence-absence detection sensor 80 of the image forming apparatus 1.

When the paper feed cassette 141 is fitted to the apparatus body 11, the cassette attachment-detachment detection sensor 70 detects the fitting of the paper feed cassette 141 (NO in step S11). Upon withdrawal of the paper feed cassette 141 from the apparatus body 11, the cassette attachment-detachment detection sensor 70 detects the withdrawal of the paper feed cassette 141 (YES in step S11).

The sensor failure determination section 101, upon recognition that the paper feed cassette 141 is withdrawn (YES in step S11), next determines whether or not paper P absence is detected by the paper presence-absence detection sensor 80 (step S12). Here, if the paper presence-absence detection sensor 80 does not detect the paper P absence, that is, if it detects paper P presence (NO in step S12), the sensor failure determination section 101 determines that the paper presence-absence detection sensor 80 is in failure, and sets a failure detection flag (step S13). On the other hand, if the paper presence-absence detection sensor 80 detects the paper P absence (YES in step S12), the sensor failure determination section 101 detects that the paper presence-absence detection sensor 80 is not in failure, that is, is normal, and does not set the failure detection flag.

Figure 6:
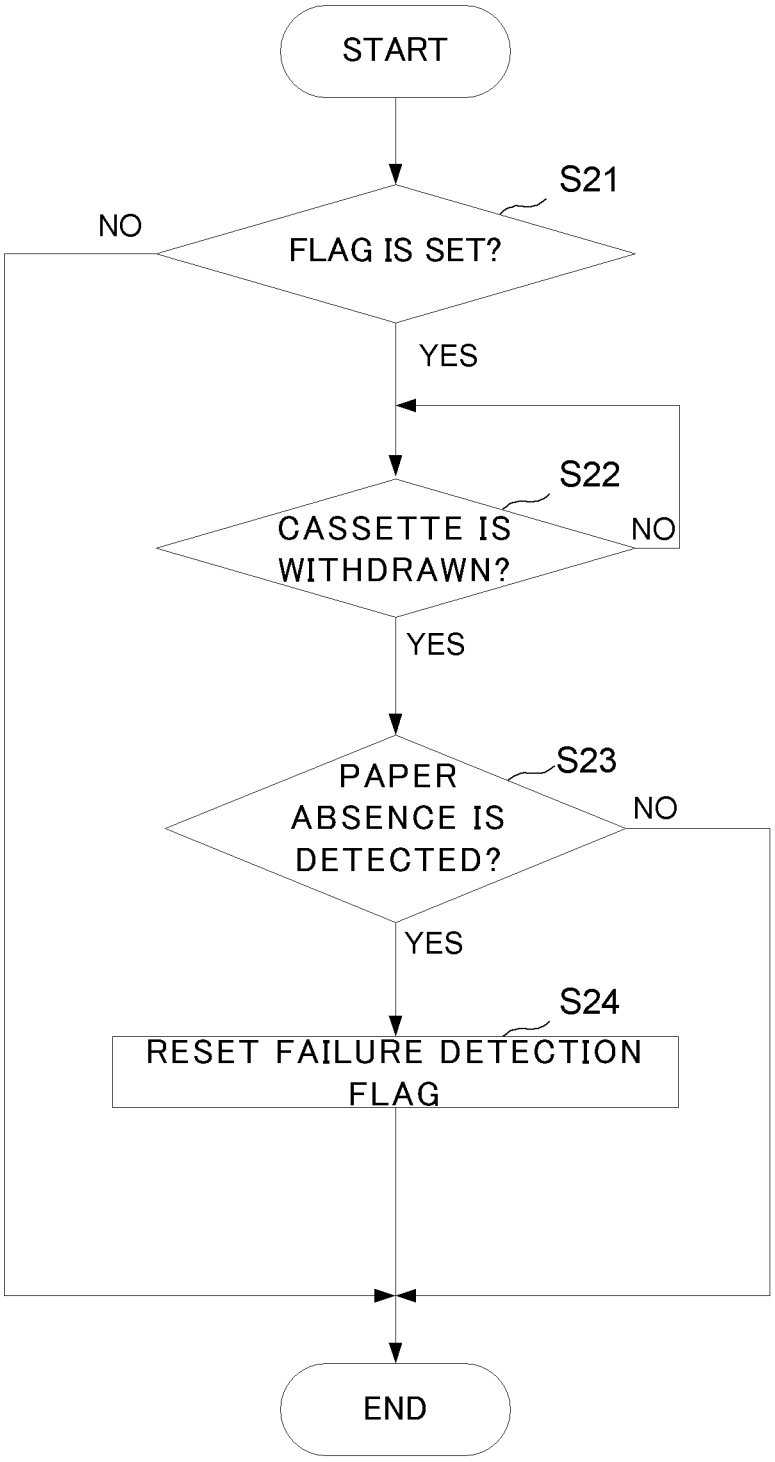
FIG. 6 is a flowchart showing a flow of failure detection release processing of the paper presence-absence detection sensor of the image forming apparatus according to one embodiment of this disclosure.

Next, failure detection release processing of the paper presence-absence detection sensor 80 will be described. FIG. 6 is a flowchart showing a flow of the failure detection release processing of the paper presence-absence detection sensor 80.

Referring to the failure detection flag, if the failure detection flag is not set (NO in step S21), the operation control section 100 ends the failure detection release processing of the paper presence-absence detection sensor 80 since the paper presence-absence detection sensor 80 is not in failure. On the other hand, when the operation control section 100 judges that the failure detection flag is set (YES in step S21), the sensor failure determination section 101 determines attachment or detachment of the paper feed cassette 141 (step S22).

When the paper feed cassette 141 is fitted to the apparatus body 11, the cassette attachment-detachment detection sensor 70 detect the fitting of the paper feed cassette 141 (NO in step S22). Upon withdrawal of the paper feed cassette 141 from the apparatus body 11, the cassette attachment-detachment detection sensor 70 detects the withdrawal of the paper feed cassette 141 (YES in step S22).

Upon recognition that the paper feed cassette 141 is withdrawn (YES in step S22), the sensor failure determination section 101 next determines whether or not paper P absence is detected by the paper presence-absence detection sensor 80 (step S23). Here, if the paper presence-absence detection sensor 80 does not detect the paper P absence, that is, if the paper P presence is detected (NO in step S23), the sensor failure determination section 101 determines that the paper presence-absence detection sensor 80 is still in failure and ends the failure detection release processing of the paper presence-absence detection sensor 80 without resetting the failure detection flag. On the other hand, if the paper presence-absence detection sensor 80 detects paper P absence (YES in step S23), the sensor failure determination section 101 determines that the paper presence-absence detection sensor 80 has restored its normal state and resets the failure detection flag (step S24).

Figure 7:
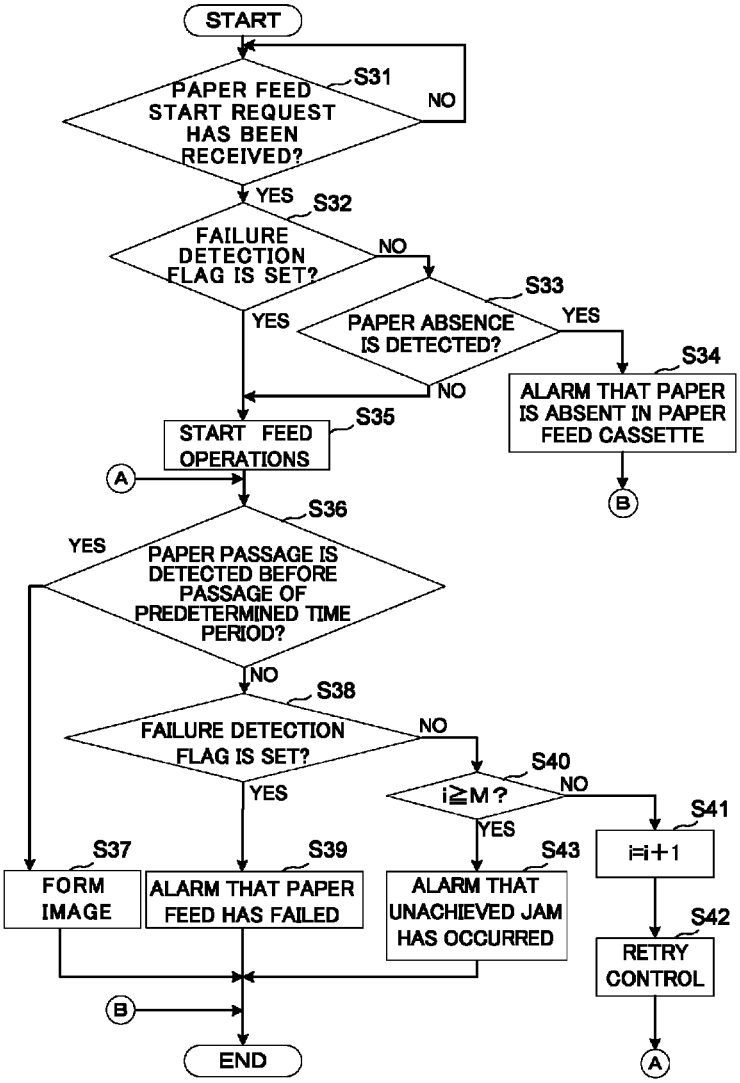
FIG. 7 is a flowchart showing a flow of feed processing and alarm processing in the image forming apparatus according to one embodiment of this disclosure.

Next, feed processing and alarm processing in the image forming apparatus 1 will be described. FIG. 7 is a flowchart showing a flow of the feed processing and the alarm processing in the image forming apparatus 1.

The operation control section 100 determines whether or not a paper P feed start request inputted from the user through, for example, the operation section 47, etc. has been received (step S31).

In a case where the paper feed start request has been received (YES in step S31), the operation control section 100 determines whether or not the failure detection flag is set (step S32). In a case where the failure detection flag is not set (NO in step S32), the operation control section 100 determines whether or not paper P absence is detected by the paper presence-absence detection sensor 80 (step S33).

In a case where the paper P absence is determined (YES in step S33), the alarm control section 102 makes the display section 473 display an alarm screen showing that paper P is absent in the paper feed cassette 141 and alarms the user that the paper P is absent in the paper feed cassette 141 (step S34-B).

In a case where the failure detection flag is set (YES in S32), or in a case where the paper P presence is determined (NO in step S33), the operation control section 100 makes the feed section 18 start the operation of feeding the paper P (step S35).

Then the operation control section 100 determines whether or not the paper passage detection sensor 63 detects the passage of the paper P before the passage of the predefined time period from the time point at which the operation of feeding the paper P was started (step S36).

In a case where the paper passage detection sensor 63 detects the passage of the paper P before the passage of the predefined time period (YES in step S36), processing of printing the paper P is performed by the nip part N and the fixing section 13 (step S37).

In a case where the paper passage detection sensor 63 does not detect the passage of the paper P before the passage of the predefined time period, (NO in step S36), the operation control section 100 determines whether or not the failure detection flag is set (step S38).

In a case where the failure detection flag is set (YES in step S38), the alarm control section 102 makes the display section 473 display the alarm screen D1 (see FIG. 4D), and alarms the user that the feeding of the paper P has failed (step S39).

In a case where the failure detection flag is not set (NO in step S38), the operation control section 100 performs the retry control of making the feed section 18 execute the feed operations again (steps S40 to 42). More specifically, the operation control section 100 determines whether or not a number i of times with which the retry of the feed operations was performed is equal to or larger than a predefined number M of times (step S40). In a case where the number i of times with which the retry of the feed operations was performed is not equal to or larger than the predefined number M of times (NO in step S40), the operation control section 100 increases, by an increment of 1, the number i of times with which the retry of the feed operations was performed (step S41), and then makes the feed section 18 execute the feed operations again (step S42-A).

In a case where the number i of times with which the retry of the feed operations was performed is equal to or larger than the predefined number M of times (YES in step S40), the alarm control section 102 makes the display section 473 display the alarm screen D2 (see FIG. 4B), and alarms the user that an unachieved jam has occurred (step S43).

As described above, in the image forming apparatus 1 according to this embodiment, the paper presence-absence detection sensor 80 is configured to detect the paper P absence regardless of whether the paper P is present or absent when the paper feed cassette 141 is withdrawn from the apparatus body 11. In a case where the cassette attachment-detachment detection sensor 70 detects that the paper feed cassette 141 is withdrawn from the apparatus body 11, when the paper presence-absence detection sensor 80 detects the paper P presence, the sensor failure determination section 101 determines that the paper presence-absence detection sensor 80 is in failure, and sets a failure detection flag. Then in a case where the operation control section 100 has made the feed section 18 execute the feed operations in a state in which the failure detection flag is set, when the paper passage detection sensor 63 does not detect the passage of the paper P before the passage of the predefined time period from the time point at which the execution of the feed operations was started, the alarm control section 102 alarms the user that the feeding of the paper P has failed.

With the aforementioned configuration, even in a case where a failure of the paper presence-absence detection sensor 80 is detected, in a case where the paper P is present in the paper feed cassette 141, the operation of feeding the paper P can be performed, and in a case where there is possibility that the paper P is absent in the paper feed cassette 141, the user can be alarmed of this. Moreover, since the sensors (the cassette attachment-detachment detection sensor 70 and the paper presence-absence detection sensor 80) normally loaded in the image forming apparatus 1 are used, without needs of adding any member, detection of a failure in the paper presence-absence detection sensor 80 can be achieved with low costs.

Typically, since the paper presence-absence detection sensor may fail, a mechanism of determining whether or not the paper presence-absence detection sensor is in failure is provided in the image forming apparatus, and if this mechanism determines that the paper presence-absence detection sensor is in failure, it is possible to stop the operation of feeding paper P from the paper feed cassette.

However, in a typical image forming apparatus, even in a case where the paper presence-absence detection sensor is in failure, paper P may be stored in the paper feed cassette. Moreover, there is no problem with the feed section itself that performs the paper P feed operation in many cases. Stopping the paper feed operation even in such a case results in deterioration in productivity of image formation, leading to lack of user friendliness.

With this embodiment, this problem can be solved. Specifically, in this embodiment, as described above, even in a case where failure in the paper presence-absence detection sensor 80 is detected, the paper P feed operation can be performed, and in a case where there is possibility that the paper P is absent in the paper feed cassette 141, the user can be alarmed of this.

Moreover, in the image forming apparatus 1 according to this embodiment, in a case where the operation control section 100 has made the feed section 18 execute the feed operations in a state in which the failure detection flag is not set, when the paper passage detection sensor 63 does not detect the passage of the paper P before the passage of the predefined time period from the time point at which the execution of the feed operations was started, the operation control section 100 performs the retry control of making the feed section 18 execute the feed operations again. Moreover, in a case where the operation control section 100 has made the feed section 18 execute the feed operations in a state in which the failure detection flag is set, when the paper passage detection sensor 63 does not detect the passage of the paper P before the passage of the predefined time period from the time point at which the execution of the feed operations was started, the operation control section 100 does not perform the retry control.

In a case where the operation control section 100 has made the feed section 18 execute the feed operations in a state in which the failure detection flag is set, when the paper passage detection sensor 63 does not detect the passage of the paper P before the passage of the predefined time period from the time point at which the execution of the feed operations was started, there is possibility that the paper P is absent in the paper feed cassette 141. Repeating the feed operations in the state in which the paper P is absent in the paper feed cassette 141 results in abrasion of, for example, the pickup roller 145, etc. that draws out the paper P from the paper feed cassette 141 page by page, which makes the paper P easily slip. However, with the aforementioned configuration, the repeated paper feed operation in the state in which the paper P is absent in the paper feed cassette 141 can be avoided, thus making it possible to prevent the abrasion of, for example, the pickup roller 145, etc.

Moreover, in the image forming apparatus 1 according to this embodiment, in a case where the operation control section 100 has performed the retry control a predefined number of time or more, when the paper passage detection sensor 63 does not detect the passage of the paper P, the alarm control section 102 can alarm the user that an unachieved jam has occurred, and with the aforementioned configuration, in a case where failure of the paper presence-absence sensor 80 is not detected, the user can be alarmed that an unachieved jam has occurred, improving the user friendliness.

Moreover, in the image forming apparatus 1 according to this embodiment, in a case where the failure detection flag is set and the cassette attachment-detachment detection sensor 70 detects that the paper feed cassette 141 is withdrawn from the apparatus body 11, when the paper presence-absence detection sensor 80 detects paper P absence, the sensor failure determination section 101 resets the failure detection flag.

With the aforementioned configuration, in a state in which the paper presence-absence detection sensor 80 is assumed to have restored from a failure state to a normal state, the failure detection flag can be reset.

Figure 4A:
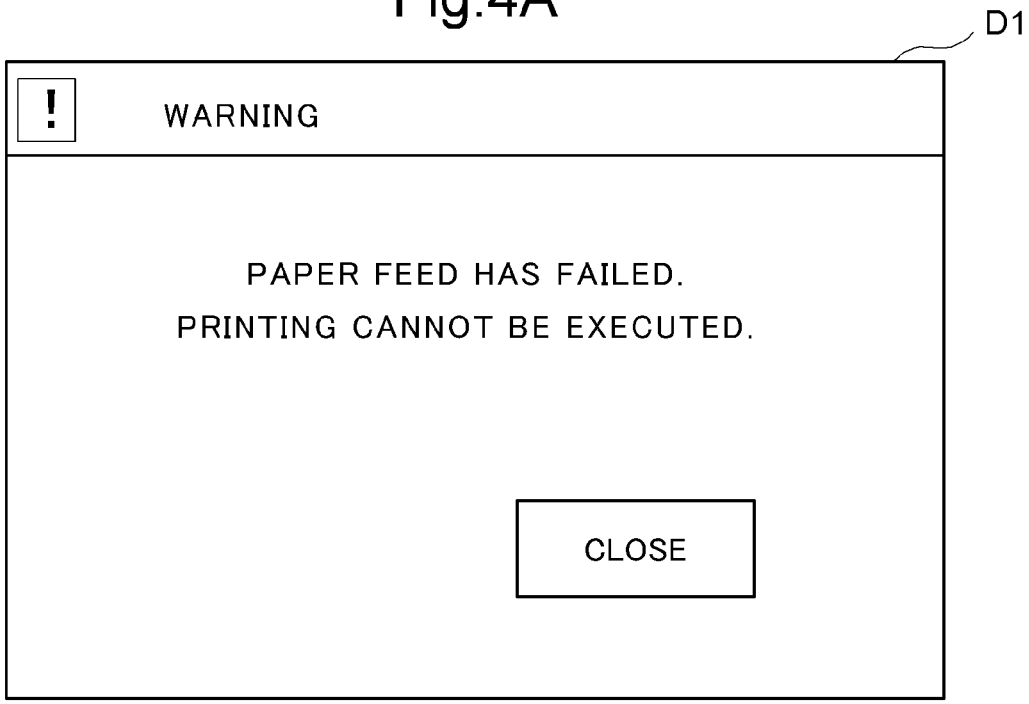
FIGS. 4A and 4B are diagrams each showing one example of an alarm screen.
Figure 4B:
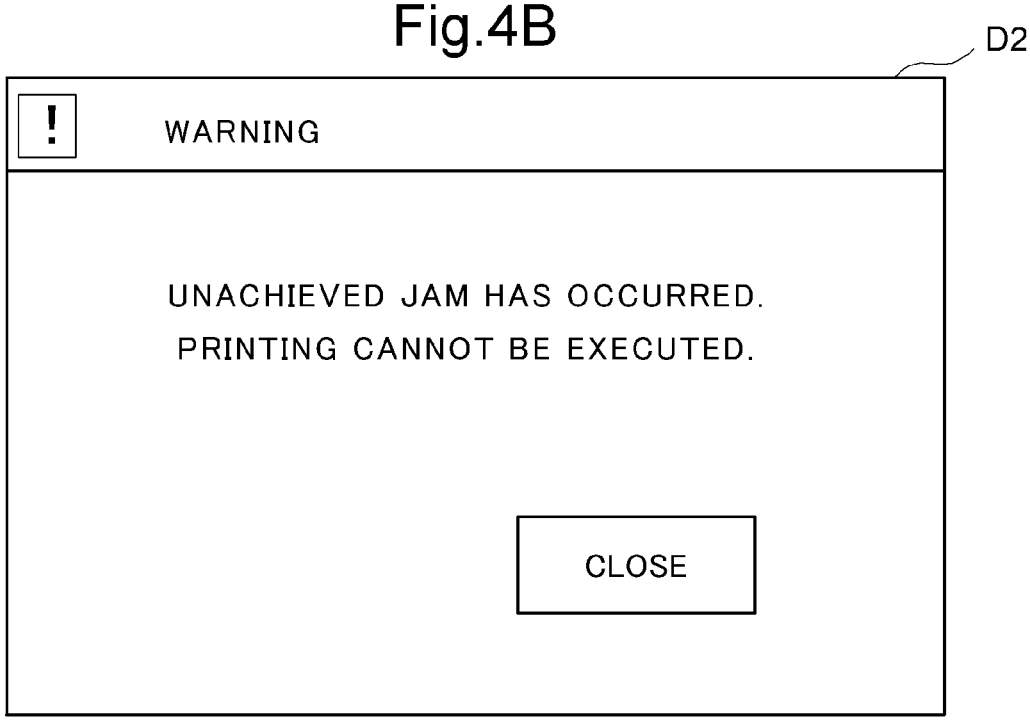

Note that this disclosure is not limited to the aforementioned embodiment, and various modification can be made. For example, the alarm screens shown in FIGS. 4A and 4B are each just one example, and this disclosure is not limited to them.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

an apparatus body;

a paper feed cassette attachable to and detachable from the apparatus body;

a feed section feeding, into the apparatus body, paper stored in the paper feed cassette;

an operation control section controlling an operation of feeding the paper by the feed section;

a paper passage detection sensor being installed along a conveyance path in the apparatus body, the paper passage detection sensor detecting whether or not the paper has passed through a position corresponding to a position at which the installation is achieved;

a cassette attachment-detachment detection sensor detecting attachment or detachment of the paper feed cassette to or from the apparatus body;

a paper presence-absence detection sensor detecting presence or absence of the paper in the paper feed cassette, the paper presence-absence detection sensor being configured to detect the paper absence regardless of whether the paper is present or absent when the paper feed cassette is withdrawn from the apparatus body;

a sensor failure determination section, when the paper presence-absence detection sensor detects the paper presence in a case where the cassette attachment-detachment detection sensor detects that the paper feed cassette is withdrawn from the apparatus body, determining that the paper presence-absence detection sensor is in failure and setting a failure detection flag; and an alarm control section, in a case where the operation control section has made the feed section execute the feed operation in a state in which the failure detection flag is set, when the paper passage detection sensor does not detect passage of the paper before passage of a predefined time period from a time point at which the execution of the feed operation was started, alarming a user that the feeding of the paper has failed.

2. The image forming apparatus according to claim 1, wherein, in the case where the operation control section has made the feed section execute the feed operation in the state in which the failure detection flag is not set, when the paper passage detection sensor does not detect the passage of the paper before the passage of the predefined time period from the time point at which the execution of the feed operation was started, the operation control section performs retry control of making the feed section execute the feed operation again, and in the case where the operation control section has made the feed section execute the feed operation in the state in which the failure detection flag is set, when the paper passage detection sensor does not detect the passage of the paper before the passage of the predefined time period from the time point at which the execution of the feed operation was started, the operation control section does not perform the retry control.

3. The image forming apparatus according to claim 2, wherein, in a case where the operation control section has performed the retry control a predefined number of times or more, when the paper passage detection sensor does not detect the passage of the paper, the alarm control section alarms the user that an unachieved jam has occurred.

4. The image forming apparatus according to claim 1, wherein, in a case where the failure detection flag is set and the cassette attachment-detachment detection sensor detects that the paper feed cassette is withdrawn from the apparatus body, when the paper presence-absence detection sensor detects the paper absence, the sensor failure determination section resets the failure detection flag.

5. The image forming apparatus according to claim 1, wherein, the cassette attachment-detachment detection sensor and the paper presence-absence detection sensor use a sensor normally loaded in the image forming apparatus.

* * * * *